US007454890B2

(12) United States Patent
Fietz

(10) Patent No.: US 7,454,890 B2
(45) Date of Patent: Nov. 25, 2008

(54) SUPPORTING DISK

(75) Inventor: Roland Fietz, Neustadt (DE)

(73) Assignee: Carl Freudenberg KG, Weinheim (DE)

( * ) Notice: Subject to any disclaimer, the term of this patent is extended or adjusted under 35 U.S.C. 154(b) by 62 days.

(21) Appl. No.: 11/602,007

(22) Filed: Nov. 20, 2006

(65) Prior Publication Data

US 2007/0130907 A1 Jun. 14, 2007

(30) Foreign Application Priority Data

Nov. 22, 2005 (EP) ..... 05025415

(51) Int. Cl.
*D01H 4/12* (2006.01)

(52) U.S. Cl. ..... 57/404

(58) Field of Classification Search ..... 57/112, 57/136; 384/549
See application file for complete search history.

(56) References Cited

U.S. PATENT DOCUMENTS 5,362,160 A 11/1994 Braun et al. ..... 384/549
5,497,441 A * 3/1996 Croitoru et al. ..... 385/125
5,517,814 A * 5/1996 Stahlecker ..... 57/406
6,286,206 B1 * 9/2001 Li ..... 29/840
6,530,206 B2 3/2003 Fietz ..... 57/406

FOREIGN PATENT DOCUMENTS

DE 41 36 793 6/1993
DE 100 46 525 4/2002

* cited by examiner

*Primary Examiner*—Shaun R Hurley
(74) *Attorney, Agent, or Firm*—Davidson, Davidson & Kappel, LLC

(57) ABSTRACT

A supporting disk for providing bearing support to a rotor of an open-end spinning machine includes a hub ring (1) and a supporting ring (2) that surrounds the hub ring (1) at least partially with radial clearance. The hub ring (1) and the supporting ring (2) each are made of a polymer material, and the hub ring (1), at least on its outer peripheral surface (3), has a metal coating (5) which is located at least partially in the gap (4) formed by the clearance, and which contiguously adjoins the inner circumferential surface (6) of the supporting ring (2), and extends axially up to at least one of the end faces (7, 8) of the supporting disk.

14 Claims, 3 Drawing Sheets

SUPPORTING DISK

This claims priority to European Patent Application Serial No. 05025415.0, filed Nov. 22, 2005 and hereby incorporated by reference herein.

The present invention relates to a supporting disk for providing bearing support to a rotor of an open-end spinning machine, including a hub ring that is peripherally surrounded by a supporting ring, the hub ring and the supporting ring each being made of a polymer material.

BACKGROUND

A supporting disk of this kind is known from the German Patent DE 41 36 793C1. The hub ring is peripherally surrounded by the supporting ring which directly adjoins it. The hub ring is made of a polymer material which has a modulus of elasticity of 7,000 to 13,000 N/m$^2$, a heat-distortion temperature of 150° C. to 250° C., as well as an elongation at fracture of 1.3% to 3%. A supporting disk of this kind is simple and inexpensive to manufacture. It should be noted in this context, however, that, during normal operational use and under conditions of high mechanical stress, such as in fulling processes, the temperature prevailing in a supporting member made of a polymer material can increase to the point where it becomes thermally damaged.

Another supporting disk is known from the German Patent Application DE 40 11 632A1. In this supporting disk, the hub ring is made of a metallic material, which is less than satisfactory from a standpoint of production engineering and economics. The hub ring must undergo a relatively complex pretreatment before being joined to the supporting ring made of polymer material.

Another supporting disk used to provide bearing support to a rotor of an open-end spinning machine is known from the German Patent DE 100 46 525 C2. The hub ring is designed as a composite part and is made of at least two different materials, i.e., of a metallic and a polymer material which are joined together non-positively and/or positively. The hub ring is formed from a disk made of aluminum which is at least partially covered by a plastic casing. Mechanical claw-type interlocking forms a durable connection between the aluminum disk and the plastic casing. The previously known supporting disk exhibits good thermal conductivity and high mechanical strength properties.

SUMMARY OF THE INVENTION

It is an object of the present invention to further refine a supporting disk in such a way that the above-mentioned disadvantages may be overcome. It is intended, in particular, to substantially improve the dissipation of heat from the supporting ring, even though a hub ring made of a polymer material will be used, making it possible to improve the working properties over a long service life, even under conditions of high mechanical stress. It is also intended that the supporting disk be able to be manufactured more simply and less expensively and for it to have a smaller inertial mass.

The present invention provides a supporting disk for providing bearing support to a rotor of an open-end spinning machine, including a hub ring and a supporting ring that surrounds the hub ring at least partially with radial clearance, the hub ring and the supporting ring each being made of a polymer material, and the hub ring, at least on its outer peripheral surface, having a metal coating which is located in the gap formed by the clearance, contiguously adjoins the inner circumferential surface of the supporting ring, and extends axially up to at least one of the end faces of the supporting disk.

In the case of a supporting disk of this kind, it is beneficial that, altogether, it has only a low weight, which does not differ significantly from that of supporting disks which have no metal coating and whose hub ring and supporting ring are each made of a polymer material. Due to the small inertial mass, the energy demand during deceleration and start-up acceleration spinning processes carried out by the open-end spinning machine is reduced to a minimum. It is also beneficial that heat is dissipated from the supporting ring to the ambient environment in a process that is similar in terms of effectiveness to that of heat dissipation from supporting disks whose hub ring is designed as an aluminum part that is comparatively expensive and complicated to machine. The operationally induced heating of the supporting ring may be dissipated via the metal coating, away from the same to the ambient environment. This greatly minimizes the danger of thermal damage to the supporting ring.

In spite of the advantageous working properties over a long service life as described above, the supporting disk is simple and inexpensive to manufacture, even on an industrial scale. Due to the efficient dissipation of heat from the supporting disk to the ambient environment made possible by the metal coating, the supporting disk exhibits good dimensional stability, so that even in the case of long-term use, the hub ring is able to be securely fixed to a shaft, for example using a low-cost press-fit connection.

The metal coating may be permanently bonded to the hub ring as well as to the supporting ring. The axial extent of the metal coating up to at least one of the end faces of the supporting disk can allow the heat to be dissipated to be given off to the ambient air of the supporting disk.

Generally, the larger the surface area of the metal coating that comes into contact with the ambient air, the more efficiently heat may be dissipated from the supporting disk to the ambient environment.

In comparison to an only partial outer peripheral metallization of the surface of the hub ring, dissipation of heat from the supporting disk may be improved when the outer peripheral surface of the hub ring is completely covered by the metal coating. The dissipation of heat from the supporting disk to the ambient environment may be significantly improved when at least one of the end faces of the hub ring is covered by the metal coating, and is enhanced to an even greater degree when both end faces of the hub ring are covered by the metal coating. The annulus surfaces of the end faces may be substantially larger than the end-face annulus surfaces of the gap between the hub ring and the supporting ring so that, even in the case of high mechanical loading of the supporting ring, for example due to fulling processes, substantial quantities of heat are given off via the metal coating to the ambient environment.

The dissipation of heat from the supporting disk may be further improved when the inner circumferential surface of the hub ring is at least partially, preferably completely, covered by the metal coating. In such a case, the transfer of heat away from the supporting disk takes place not only via the end-face metal coating thereof to the ambient air, but also from the metallized inner circumferential surface of the hub ring to the shaft on which the hub ring is mounted.

Maximum thermal conductivity from the supporting disk to the ambient environment may be attained when the entire surface of the hub ring is covered by the metal coating. The comparatively higher cost entailed in completely metallizing the hub ring may be offset by the advantage of a maximum dissipation of heat from the supporting ring.

The claimed supporting disk has a small inertial mass, is simple and inexpensive to manufacture, has only a low energy demand during deceleration and acceleration processes, and features an efficient dissipation of heat from the supporting ring.

An especially reliable and durable attachment of the hub ring to a shaft, as provided, for example, by simple axial pressing of the hub ring onto the shaft, may be accomplished when the inner circumferential surface of the hub ring has at least one radially inwardly open groove in which a congruently shaped annular insert of tough, hard material, for example of a metallic material, is placed. The insert may have an annular circular shape or an annular polygonal shape. To increase surface roughness, the outer peripheral surface of the insert may be knurled, for example. A durable claw-type interlocking of the insert with the hub ring may thereby be achieved. As a result, a reliable press fit may be ensured even over a long service life, thereby eliminating the need in most applications for complex shaft-hub connections, such as spline profiles or spline fittings, as generally known from mechanical engineering.

With regard to achieving a simple and problem-free assembly, it may be advantageous when the hub ring and the insert form one preassemblable unit.

The insert and the metal coating may essentially be made from compatible materials. Because compatible materials are used, the thermal expansion coefficients are also compatible, making it possible to at least partially compensate for undesirable strains within the supporting disk.

The thickness of the metal coating preferably may be, at most, 3 mm. The metal coating is most preferably 0.001 to 1.0 mm thick. In such a case, an especially favorable cost-benefit ratio is obtained.

In exceptional cases, a metal coating having a thinner thickness may be provided, for example when the material used for the metal coating has excellent thermal conductivity properties, such as copper or some of the noble metals.

The metal coating may be applied to the hub ring made of a polymer material using generally known methods, such as galvanic deposition, lacquering, water-transfer pressure coating, vacuum coating or vapor deposition. Metallization using thermoforming systems or physical-chemical vapor deposition is also conceivable.

The metal coating may be made of metal or of alloys of copper, zinc, aluminum, chromium, nickel, tin, or of iron alloys, such as steel or stainless steel.

In exceptional cases, noble metals may also be used for the metallization process.

The metal coating may be formed altogether as a single-layer coating. It is advantageous in this context that a coating of this kind is able to be easily and quickly produced, making the supporting disk simple and inexpensive to manufacture.

Alternatively, the metal coating may be formed as a multi-layered coating. In the case of a multi-layered metal coating, on the whole, greater layer thicknesses are advantageously attainable, so that the thermal conductivity is improved over thinner, single-layered metal coatings.

Moreover, in the case of the multi-layered metal coating, it is possible to advantageously combine the beneficial properties of different metals, for example the good thermal conductivity properties of copper, covered by an especially corrosion-resistant layer of tin.

BRIEF DESCRIPTION OF THE DRAWING

Two exemplary embodiments of the supporting disk according to the present invention are explained in greater detail in the following with reference to FIGS. 2 and 3. They show schematically.

DETAILED DESCRIPTION

Figure 1:
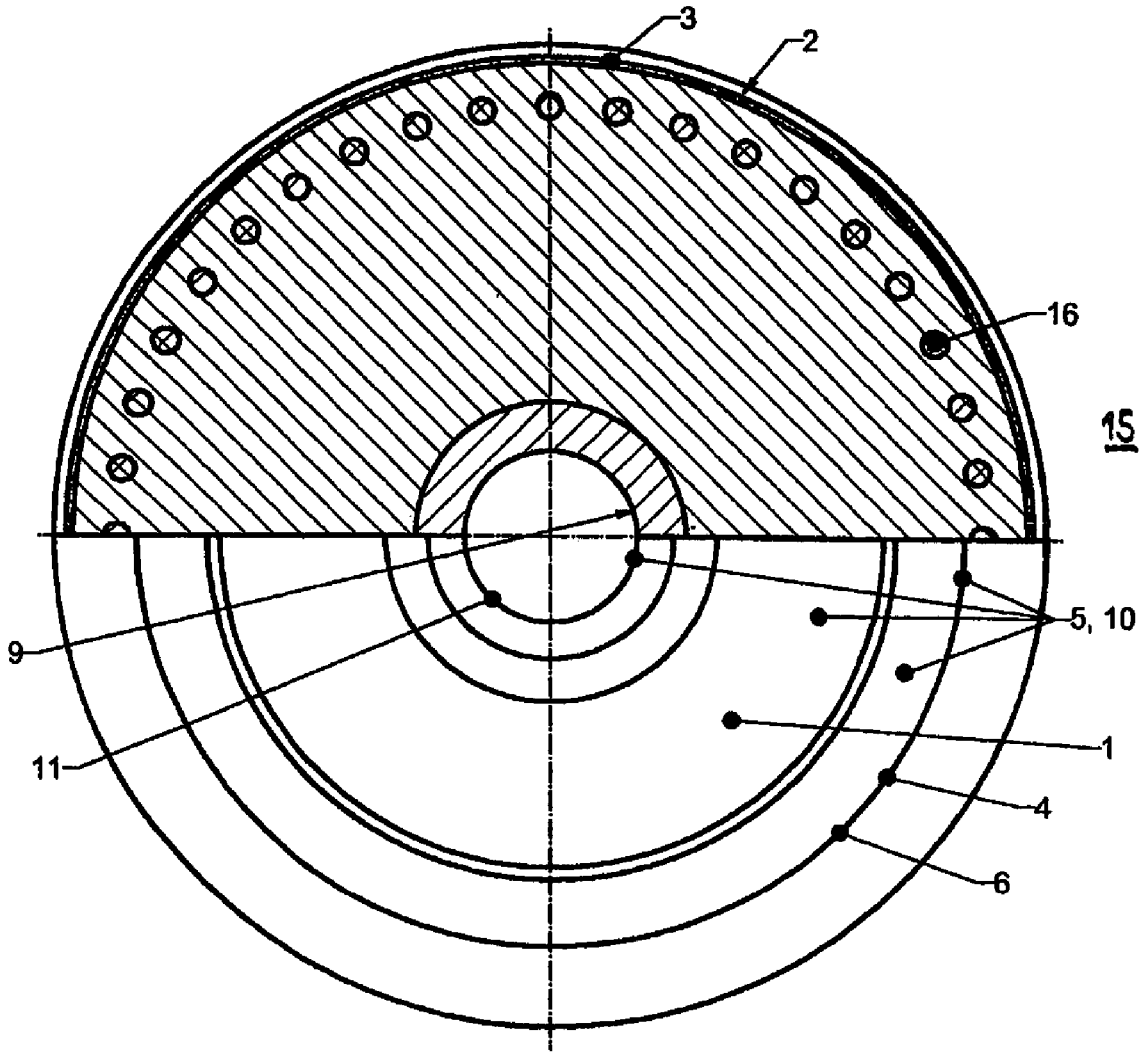
FIG. 1: a supporting disk according to FIGS. 2 and 3 in a front, part-sectional view.
Figure 2:
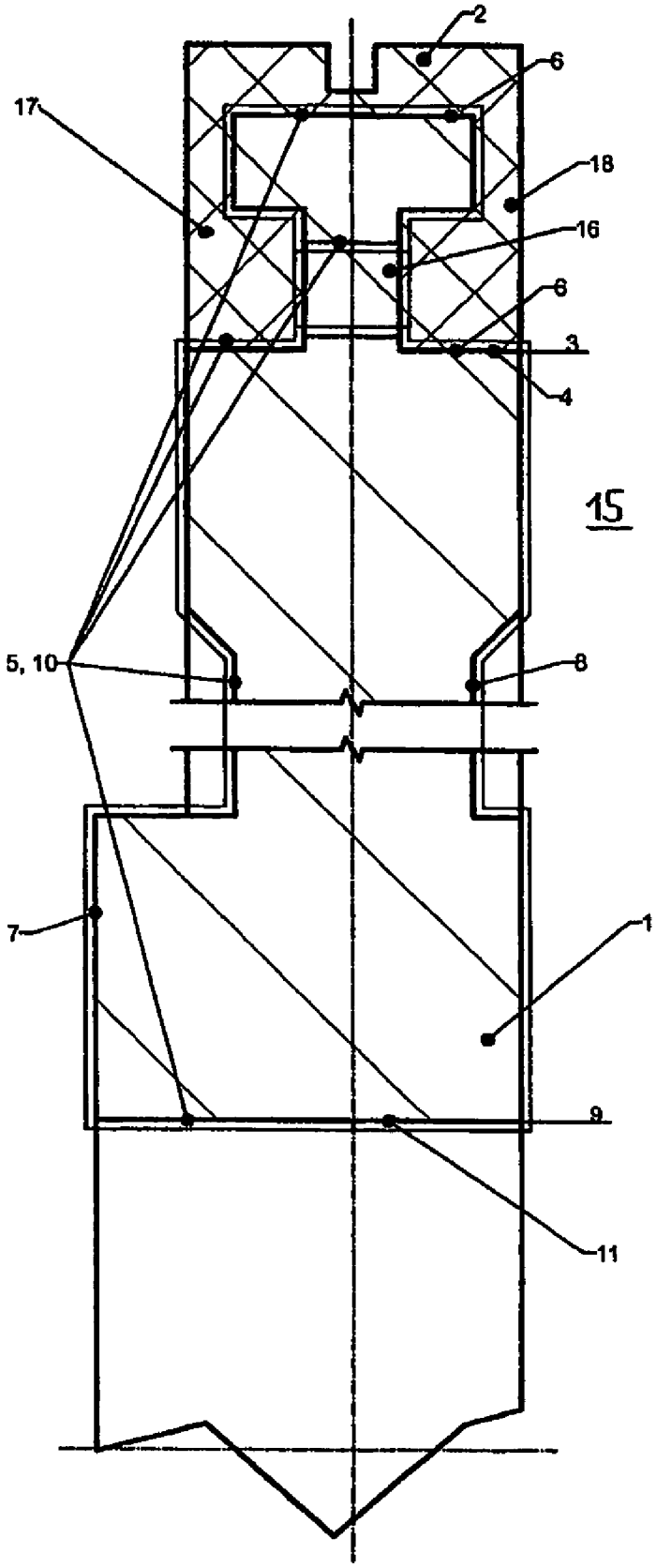
FIG. 2: a first exemplary embodiment of a supporting disk, the hub ring being mountable on a shaft by axial pressing action, without the use of secondary devices.
Figure 3:
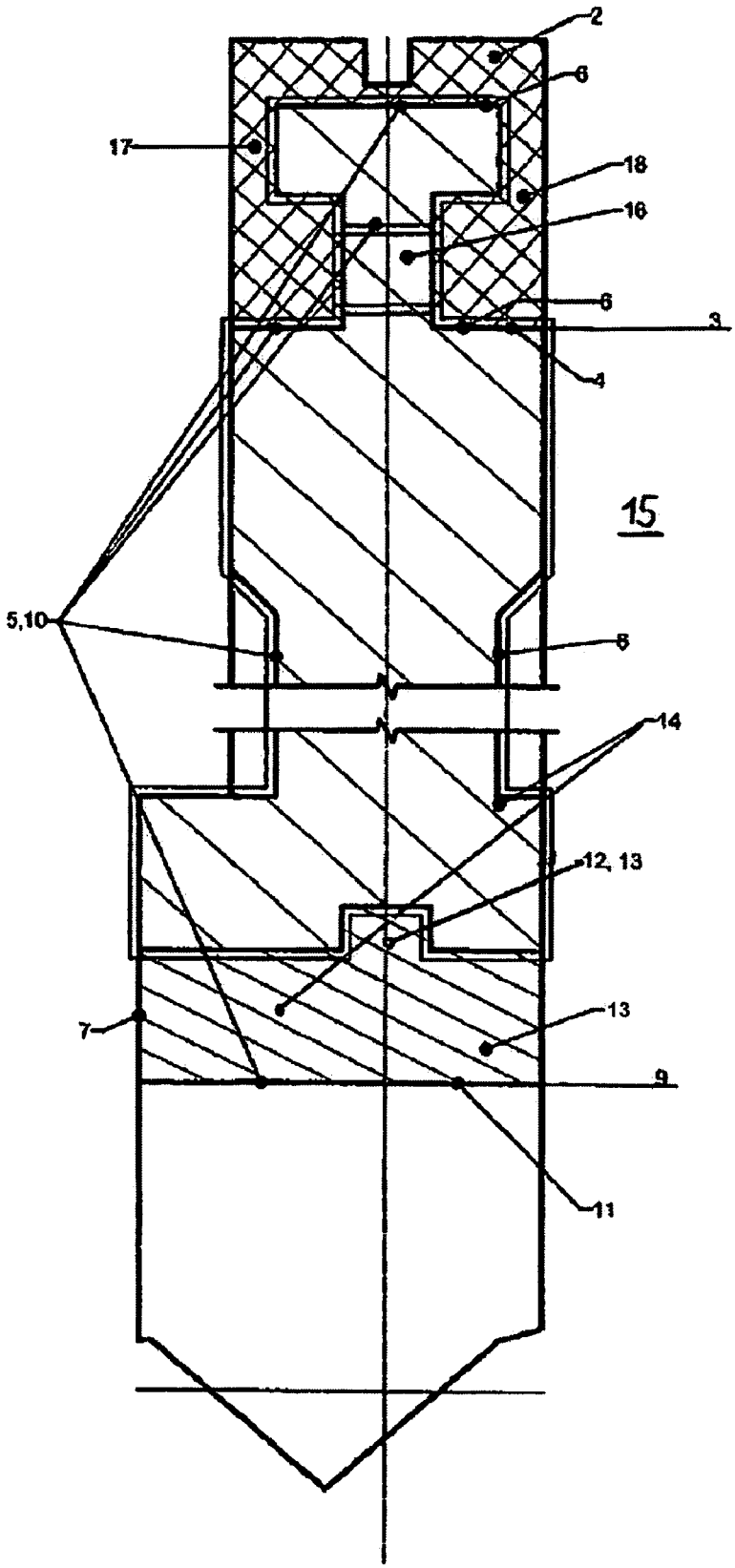
FIG. 3: a second exemplary embodiment of a supporting disk, similar to that of FIG. 2, to attach the hub ring, an annular insert being additionally used in the area of the inner circumferential surface of the hub ring.

In FIG. 1, the exemplary embodiments are shown in a front, part-sectional view in accordance with FIGS. 2 and 3. The supporting disk encompasses hub ring 1 which is made of polymer material, entire surface 10 of hub ring 1 being covered by metal coating 5, including inner circumferential surface 9 of hub ring 1. A supporting ring 2 surrounds hub ring 1 at least partially with a radial clearance to form a gap 4. Metal coating 5 may be located in gap 4 such that metal coating 5 contiguously adjoins an inner surface 6 of supporting ring 2 with an outer peripheral surface 3 of hub ring 1.

Likewise conceivable is a metal coating 5 which only covers partial regions of entire surface 10, for example only end faces 7, 8 (FIGS. 2, 3) and outer peripheral surface 3 of hub ring 1.

Since metal coating 5 is used for dissipating heat from supporting ring 2 to ambient environment 15, partial metal coating regions 5 are to be contiguously formed to make possible a heat transfer therebetween.

FIGS. 2 and 3 show two different exemplary embodiments, entire surface 10 of hub ring 1 being covered by metal coating 5 in each case. Metal coating 5 is graphically illustrated by the boundary lines of hub ring 1. Hub ring 1 essentially has an I-shaped design and, within its radial extent, has perforations 16 which are spaced uniformly over the circumference and are penetrated by the polymer material of supporting ring 2. In the exemplary embodiment shown here, supporting ring 2 has an essentially U-shaped profile which, by its radially inwardly projecting side pieces 17, 18, wraps around the I-shaped profile of hub ring 1. Side pieces 17, 18 are integrally merged into one another by traversing perforations 16 of hub ring 1, so that supporting ring 2 is not only attached to hub ring 1 adhesively, indirectly by metal coating 5, but also by a mutual, wrap-around form-locking of hub ring 1 and supporting ring 2. As a result, even at the highest speeds, there is no danger of supporting ring 2 becoming detached from hub ring 1 under the action of centrifugal forces.

In FIG. 3, an exemplary embodiment is shown similar to that of FIG. 2, an annular insert 13 additionally being provided, which is located in a radially inwardly open groove 12 of hub ring 1 formed in inner circumference 11 thereof. Insert 13 is shaped congruently to groove 12 and is flush-fitted in inner circumference 11 of hub ring 1. Hub ring 1 and insert 13 may be formed as a preassembled unit 14. In the exemplary embodiment shown here, insert 13 is made of the same material as metal coating 5. Therefore, metal coating 5 and insert 13 have substantially compatible thermal expansion coefficients.

Metal coating 5 provides an efficient dissipation of heat from supporting ring 2 to ambient environment 15, the heat dissipation essentially corresponding to that of an equivalently designed supporting disk having a hub ring of aluminum. In comparison, however, the supporting disk according to the present invention is simpler and less expensive to manufacture and has a smaller inertial mass which is advantageous in consideration of deceleration or acceleration conditions.

What is claimed is:

1. A supporting disk for providing bearing support to a rotor of an open-end spinning machine, the supporting disk having two end faces, the supporting disk comprising:

a hub ring having an outer peripheral surface; and a supporting ring surrounding the hub ring at least partially with radial clearance to form a gap, the supporting ring having an inner circumferential surface, the hub ring and the supporting ring each being made of a polymer material, the hub ring, at least on the outer peripheral surface, having a metal coating located at least partially in the gap, the metal coating contiguously adjoining the inner circumferential surface of the supporting ring and extending axially to at least one of the end faces of the supporting disk.

2. The supporting disk a recited in claim 1 wherein the outer peripheral surface of the hub ring is completely covered by the metal coating.

3. The supporting disk as recited in claim 1 wherein the hub ring has hub end faces, at least one of the hub end faces being covered by the metal coating.

4. The supporting disk as recited in claim 3 wherein both hub end faces are covered by the metal coating.

5. The supporting disk as recited in claim 1 wherein the hub ring has a hub inner circumferential surface at least partially covered by the metal coating.

6. The supporting disk as recited in claim 1 wherein an entire outer surface of the hub ring is covered by the metal coating, the entire outer surface including the outer peripheral surface.

7. The supporting disk as recited in claim 1 wherein hub ring has a hub inner circumferential surface having at least one radially inwardly open groove and further comprising a congruently shaped annular insert of tough, hard material in the open groove.

8. The supporting disk a recited in claim 7 wherein the insert is made of a metallic material.

9. The supporting disk as recited in claim 7 wherein the hub ring and the insert form one preassembly unit.

10. The supporting disk as recited in claim 7 wherein the insert and the metal coating are made from compatible materials.

11. The supporting disk as recited in claim 1 wherein a thickness of the metal coating is, at most, 3 mm.

12. The supporting disk as recited in claim 11 wherein the thickness of the metal coating is 0.001 to 1.0 mm.

13. The supporting disk as recited in claim 1 wherein the metal coating is formed altogether as a single-layer coating.

14. The supporting disk as recited in claim 1 wherein the metal coating is formed as a multi-layered coating.

* * * * *